United States Patent [19]

Piper

[11] Patent Number: 4,559,411

[45] Date of Patent: Dec. 17, 1985

[54] UNITARY WOVEN JACKET AND ELECTRICAL TRANSMISSION CABLE AND METHOD FOR PRODUCTION

[76] Inventor: Douglas E. Piper, 21 Buckingham Rd., Greenville, S.C. 29607

[21] Appl. No.: 625,660

[22] Filed: Jun. 28, 1984

Related U.S. Application Data

[63] Continuation-in-part of Ser. No. 466,564, Feb. 15, 1983, Pat. No. 4,460,803.

[51] Int. Cl.[4] ..... H01B 7/08; D03D 15/00

[52] U.S. Cl. ..... 174/117 M; 29/857; 139/425 R

[58] Field of Search ..... 174/36, 117 M; 29/857; 139/425 R

[56] References Cited

U.S. PATENT DOCUMENTS

| | | | |
|---|---|---|---|
| 3,582,537 | 6/1971 | Perreault | 174/117 M |
| 3,909,508 | 9/1975 | Ross | 174/117 M |
| 4,095,042 | 6/1978 | Ross | 174/36 |
| 4,143,236 | 3/1979 | Ross et al. | 174/117 M X |
| 4,229,615 | 10/1980 | Orr, Jr. et al. | 174/117 M |
| 4,281,211 | 7/1981 | Tatum et al. | 174/36 |
| 4,460,803 | 7/1984 | Piper | 174/36 |

*Primary Examiner*—A. T. Grimley
*Assistant Examiner*—Morris H. Nimmo
*Attorney, Agent, or Firm*—Cort Flint

[57] ABSTRACT

A unitary woven jacket electrical transmission cable and method are disclosed which include weaving a continuous length of cable structure (10) which includes jacketed sections (A), non-jacketed sections (B), and cut-line sections (C). In the jacketed section (A), the cable structure includes a woven transmission cable (14) which is surrounded by a woven cover (12) which is made integral with the cable by weaving. In the non-jacketed section (B), the woven cover, which is tubular in the jacketed section, is closed and woven in a flat weave (32) with the electrical conductors **(16*a*, 16*b*) being unwoven and floated on the outside of the flat weave structure. The cut-line section C is woven in the form of a short length of jacket section (A). In the method, the conductors and cable structure is cut across the cut-line sections (C) to make a number of individual woven jacketed electrical transmission cables. The cables so produced include a non-jacketed section on each end followed by a short cut portion of section C. The conductors (16*a*, 16*b*) are bound in the first portion of section (C) but may be freed for termination by severing section (B). The woven cover (12) is closed at (34) by the criss-crossing the conductors and flat weave structure. The closure of the tubular weave improves the termination of the cables so that the epoxy potting material (42) normally used in a terminal connector (38)** does not flow back into the open tubular woven cover.

23 Claims, 8 Drawing Figures

UNITARY WOVEN JACKET AND ELECTRICAL TRANSMISSION CABLE AND METHOD FOR PRODUCTION

BACKGROUND OF THE INVENTION

This is a continuation-in-part of application Ser. No. 06/466,564, filed Feb. 15, 1983, now U.S. Pat. No. 4,460,803, issued on July 17, 1984, entitled "Unitary Woven Jacket and Electrical Transmission Cable" wherein a woven electrical transmission cable and protective outer woven cover are woven together in a unitary construction.

The present application relates to this type cable and the improved mass production and termination of such a cable.

Certain termination methods require a potting material to seal the conductor wires in the terminal connector after connection of the conductors to the pins and/or sockets of the connector is made. If the woven cover is left open, as in its tubular configuration, seepage of the potting material into the cover is possible as is often the case. The potting material hardens on the cable and becomes brittle. Flexing of the cable results in cracking and breaking of the hardened potting material, and, quite often, breaking of the conductors.

The invention relates to flexible woven high frequency transmission cables of the type which are generally flat and include a plurality of conductors extending in the warp direction of the cable which transmit high frequency signals such as utilized in communication and computer systems. In routing the cables through the chassis of the computer or other installation, it is often necessary to flex and distort the cable in reaching to a specific location. The cable also encounters considerable wear and abrasion in use. This wear and abrasion, as well as the distortion of the cable conductors in routing the cable, often cause changes in the cable characteristics which influence the accuracy of the signal being transmitted and the life of the cable.

Moreover, programming of certain looms to make large numbers of the cables, particularly in short lengths, is quite inefficient and requires constant machine attendance.

Accordingly, an important object of the present invention is to provide a flexible woven high frequency transmission cable having a unitary woven cover which may be made in any lengths in large numbers in an efficient manner.

Another important object of the present invention is to provide a flexible one-piece woven electrical transmission cable and jacket wherein the jacket protects both the physical and electrical characteristics of the cable and has improved termination programming capabilities.

Yet another important object of the present invention is to provide a woven high frequency transmission cable having an outer tubular woven cover which terminates in a closed flat weave to prevent seepage of potting material back into the cable and cover from a potted terminal connector.

SUMMARY OF THE INVENTION

The above objectives are accomplished according to the present invention by providing a cable structure having jacketed sections consisting of an outer woven tubular cover and an inner electrical transmission cable wherein a common weft yarn is woven between the cover and cable to join them physically as one-piece. Non-jacketed sections are included in the cable structure wherein the open tubular weave of the cover is reduced to a closed flat weave with the conductors broken out. In the method, a plurality of jacketed and non-jacketed sections are provided in a continuous cable length. A cut-line section in which all the conductors are bound is woven between the ending non-jacketed section of a first jacketed cable and the beginning non-jacketed section of a second jacketed cable. The continuous length cable structure is severed across the cut-line sections to produce individual jacketed cables. The closed flat weave closes the tubular cover to the seepage of potting material from the connector which is affixed at the non-jacketed end sections.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 2:
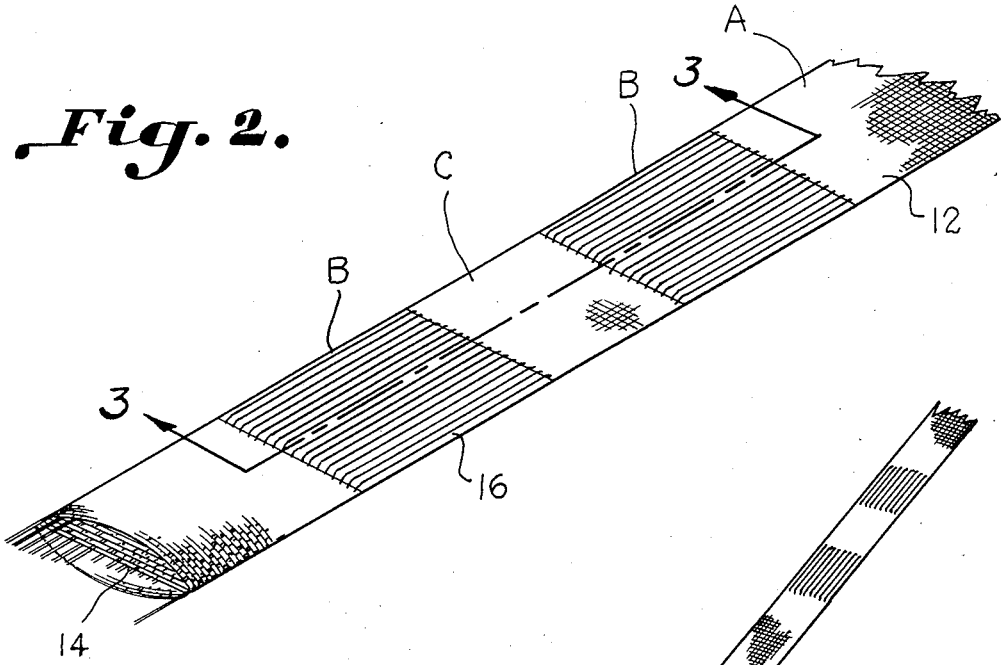
FIG. 2 is a partial perspective view illustrating a unitary woven jacketed cable and method therefor according to the present invention.
Figure 1:
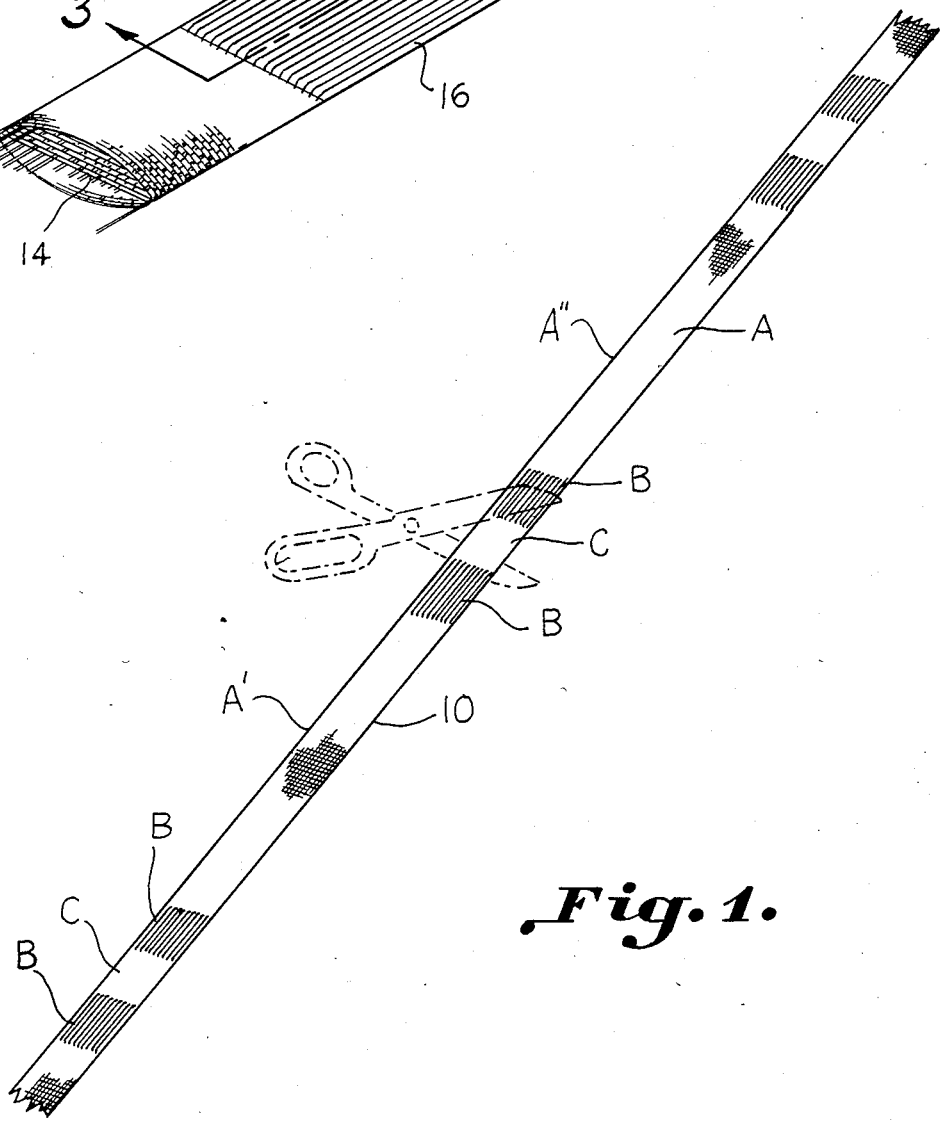
FIG. 1 is a perspective view illustrating a continuous length of unitary jacketed woven transmission cable and method according to the present invention with alternating jacketed and non-jacketed sections.

Referring now in more detail to the drawings, FIGS. 1 and 2 illustrate a continuous length of jacketed woven cable structure 10 is illustrated which includes a plurality of jacketed sections A, non-jacketed sections B, and cut-line sections C. The jacketed section A includes an outer woven cover 12 and an inner woven high frequency electrical transmission cable 14. Any construction may be had for the woven transmission cable 14 in which electrical warp conductors are bound by weaving. The present invention is particularly advantageous with a construction illustrated in U.S. Pat. No. 4,143,236 for a controlled impedance high frequency transmission cable. The cable 14 and cover 12 may be woven together in a one-piece configuration as disclosed in the above identified parent application, U.S. Pat. No. 4,460,803, issued on July 17, 1984, incorporated herein by reference. Transmission cable 14 includes a plurality of warp elements extending in a warp direction which include a number of warp conductors 16 and warp yarns 18. The warp conductors include signal conductors 16*a* and ground conductors 16*b* as can best be seen in FIGS. 4 and 4A. Signal conductors 16*a* are arranged in a substantially side-by-side relationship for transmitting high frequency electrical transmission signals.

Longitudinally extending ground wires 16*b* are carried on each side of the signal wires 16*a*. A ground wire 16*b* is carried on one side of signal wire 16*a* and a ground wire 16*b* is carried on the opposing side of each signal wire 16*a* along the length of the cable. The configuration of the ground and signal wires in the weave pattern of the woven cable may be had in any configuration such as that illustrated in U.S. Pat. No. 4,143,236.

Figure 6:
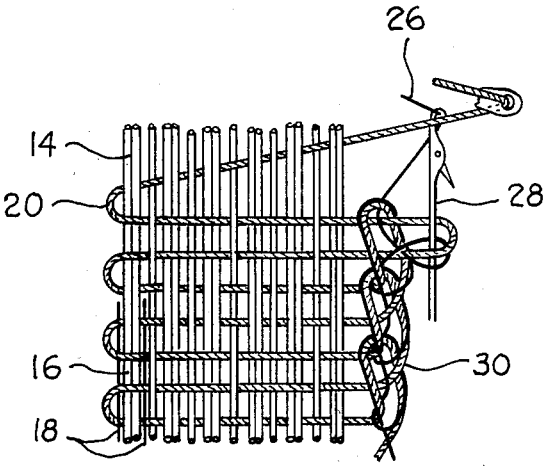
FIG. 6 is a schematic view illustrating the catch cord weave for a typical cable woven on a needle loom, the particular view being a schematic of a closed flat weave in a non-jacketed cable section according to the invention.

The cable warp yarns 18 are woven with a cable weft yarn element 20 (FIG. 6). The cable weft yarn 20 is interwoven with the warp yarns 18 as well as the conductors 16 which extend in the warp direction and thus form warp elements. This provides an integral woven cable fabric. The cable may also be constructed in a conventional twill weave pattern wherein the conductor elements 16 are the only warp elements in the cable and are woven with cable weft element 20.

Woven cover 12 includes a cover weft yarn element which in the illustrated embodiments consists of the same weft element 20 of the woven cable. Cover weft yarn 20 is woven with a plurality of warp yarns in an open tubular weave configuration around inner cable 14 (FIG. 3).

Outer cover 12 and inner cable 14 are woven simultaneously on a loom, preferably a narrow fabric needle loom. This type loom is fast and utilizes a catch cord 26 and a knitting needle 28 to knit the weft 20 at one edge of the fabric of the cable and cover such as at edge 30 of the cable structure in FIG. 6. Having been taught the construction and method for a one-piece woven jacket and transmission cable according to the invention, one skilled in weaving would readily be able to program the weaving and making of such a cable on a loom.

Figure 4A:
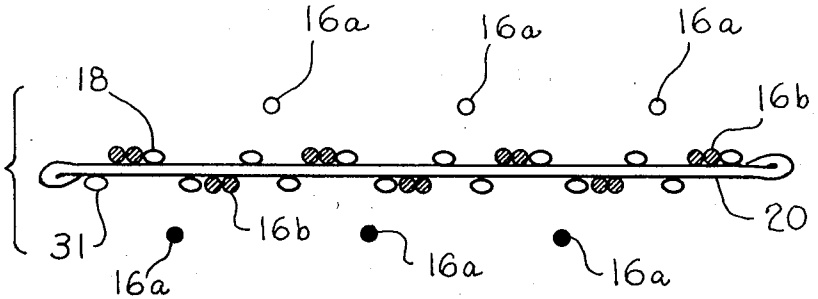
FIG. 4A is a schematic view illustrating a section taken along line 4A—4A of FIG. 3 according to the present invention.
Figure 3:
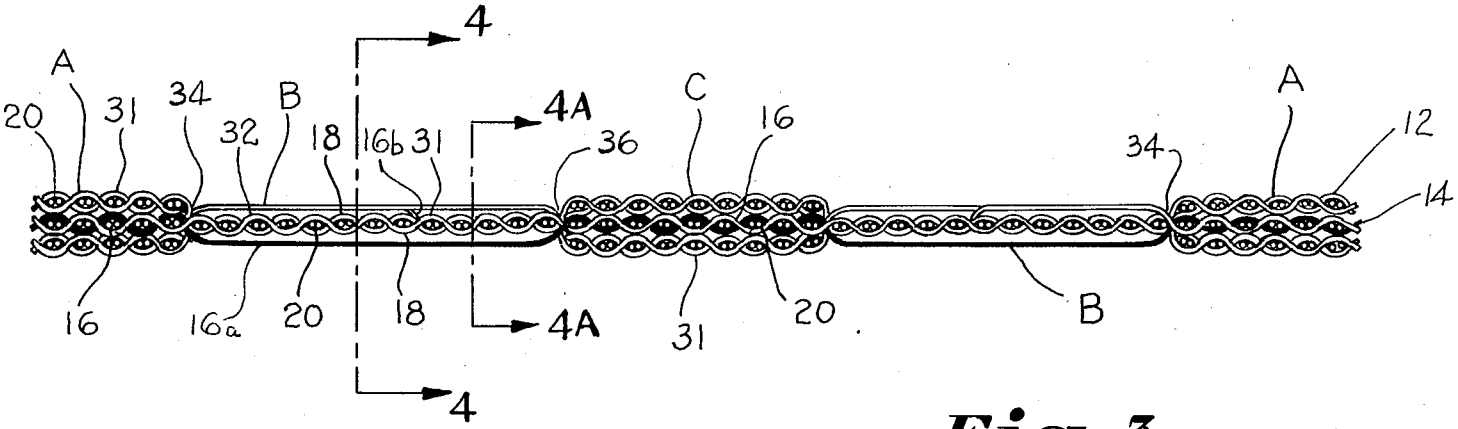
FIG. 3 is a sectional view illustrating jacketed cable sections, non-jacketed cable sections, and cut-line sections woven in a continuous length cable structure according to the present invention taken along line 3—3 of FIG. 2.
Figure 4:
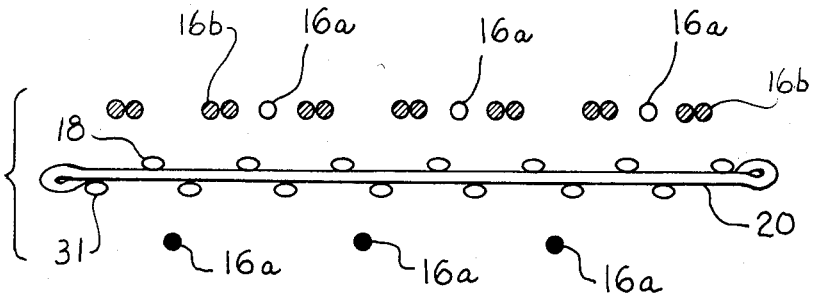
FIG. 4 is a schematic view illustrating a section taken along line 4—4 of FIG. 3 according to the present invention.

In a preferred embodiment, which can best be seen in FIGS. 3, 4 and 4A weft yarn 20 is woven in cover 12 with cover warp yarns 31 exclusive of cable 14 for a number of picks. The weft yarn is then broken out of the cover and woven through the cable 14 for a number of picks. The common weft yarn is then broken out and returned to the weaving of outer cover 12. The cover 12 and cable 14 are thus interwoven with each other and physically attached as one-piece. A more detailed description of this construction may be had by reference to U.S. Pat. No. 4,460,803 described above.

Owing to weaving of cover 12 in tubular form, weft 20 tends to pull in the sides of cable 14 altering the spacing of adjacent conductors thus affecting the cable characteristics. Preferably, the edge wires are 28 gauge where the remaining interior conductors are 34 gauge. The heavier gauge wire is sufficient to resist pulling in of the cable sides by weft 20.

Figure 5:
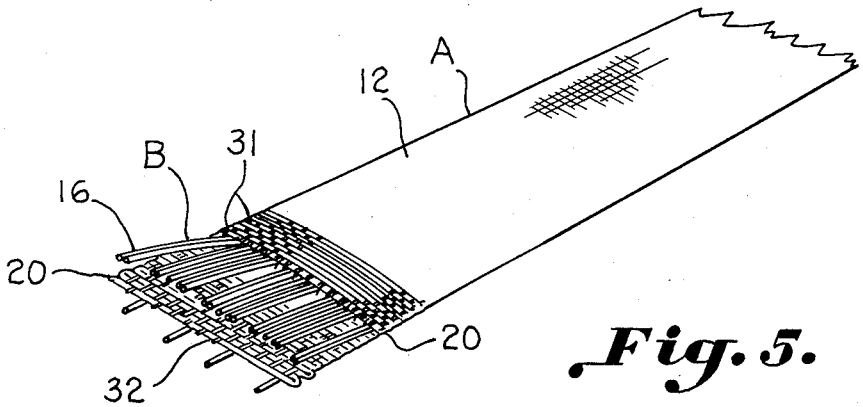
FIG. 5 is a perspective view illustrating a unitary woven jacketed cable having a jacketed section and a non-jacketed section and method therefor according to the present invention.

Referring now to non-jacketed section B, as can best be seen in FIGS. 3–5, tubular woven cover 12 is reduced to a closed flat woven fabric structure 32. In the flat weave structure 32 all of the cover and cable warp yarns 31, 18 are woven with the weft yarn 20 and the warp conductors 16 are left unbound and freely floated on either side of the flat fabric structure.

Viewing the cable structure of FIG. 3 as being woven from left to right it can be seen that conductors 16 break out of the tubular jacket 12 of the jacketed section A at 34, which is the beginning of the non-jacketed section B. The conductors 16 are broken out on both sides of the closed flat weave 32. Approximately three-quarters of the way down the non-jacketed section B the ground conductors 16*b* are woven back into the closed flat weave structure 32 and are woven together with the warp yarns 18, 31 of the jacket end cable in the flat weave 32. The remaining conductors 16 weave back into the cut-line section C at 36.

In the preferred embodiment, the cut-line section C is woven as an auxiliary jacketed section of minor length. The weave of the cut-line section C is then the same as the jacketed section A except that it is of only a minor length so that the continuous length cable structure 10 can be severed across this cut-line section.

In accordance with the method, the continuous length cable structure is first severed across the cut-line section C. This produces a number of individual jacketed woven cables having a length corresponding generally to the desired length of the cable in the section A. The woven jacketed cable thus produced will have a non-jacketed section B on each end thereof which is followed by a cut portion of the auxiliary jacketed section C. Thus all the conductors will remain bound in the individually cut and produced woven jacketed cables A. For example, as can best be seen in FIG. 1, the cut cable will include a section A, two sections B on each end thereof and two severed sections C adjacent each section B.

Figure 7:
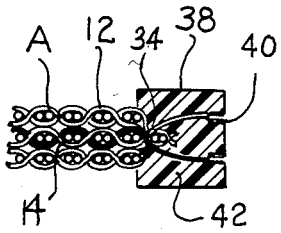
FIG. 7 is a schematic view illustrating a terminated unitary woven jacketed cable and method therefor according to the present invention.

It will be noted, as can best be seen in FIGS. 3 and 7, that the weaving point 34 at the junction of the jacketed section A and the non-jacketed section B on each end thereof will define a closure point where the open interior of the tubular cover 12 is closed. When a terminal connector is fixed to the ends of the jacketed cable A for finishing the cable, as can best be seen in FIG. 7, the interior of the woven cover 12 of the jacketed section A will be closed to the potting material 42. This prevents the tendency of the potting material 42 to flow back into the tubular cover and result in brittleness in the area of the terminal connector and avoids the problems heretofore discussed in connection therewith. The terminal connector 38 is affixed to the end of the jacketed section A and the conductors 16 are terminated in a conventional manner by soldering to sockets 40. In the method, the continuous length cable structure is severed at the cut-line section C. This leaves all the conductors bound at the ends of jacketed sections A. Next, the non-jacketed sections B are severed in the area of line 4A—4A of FIG. 3. This leaves the ground conductors 16*b* still bound in the flat weave 32, but the signal conductors 16*a* are cut and free. The signal conductors 16*a* are thus folded back and positioned for termination. Next, the flat weave 32 may be cut in the area of line 4—4 of FIG. 3. This frees the ground conductors 16*b* so that they are unbound and available for termination. In this manner, the conductors may be terminated in a programmed and orderly fashion.

In accordance with the method of mass producing unitary jacketed woven transmission cables of the type described herein, a continuous length of cable structure 10 is woven. The continuous length cable structure is best described by viewing it from left to right, as can best be seen in FIG. 1, with an auxiliary jacketed section or cut-line section C as the beginning of the structure or weaving method. Next, a non-jacketed section B is woven on one end of a jacketed section A' and a second non-jacketed B is woven at the other end of the jacketed section A'. The weaving follows with a cut-line section C which is followed by a jacketed section B at the beginning of a second jacketed cable A". At the end of jacketed cable A" is a non-jacketed cable section B followed by a cut-line section C. This weaving pattern is followed along the continuos length of the cable structure 10 until a desired number of individual woven jacketed cables A are produced and severed by cutting the cable structure across the cut-line section C. It will be noted that the non-jacketed section B at the end of woven jacketed cable A' and the non-jacketed section B at the beginning of woven jacketed cable A" define a pair of adjacent non-jacketed sections. There is a cut-line section C between each non-jacketed section in the adjacent pair.

In the method, the jacketed section A is woven to produce a woven jacketed electrical transmission cable as heretofore described. Simultaneously with the weaving of the cable, a woven cover 12 is woven around the woven cable. The woven cover 12 and woven cable 14 are interwoven at selective points of weaving along the length of the cable section 18 so that they are attached together as one piece. In the non-jacketed longitudinal sections B the woven cover 12 is reduced to the flat weave 32 and the warp conductors 16 are broken out of the woven cable and cover at 34 and 36 and extend unbound on either side of the flat weave 32.

While the invention is illustrated as using a single weft system, separate weft systems may be used for the cover and cable with interweaving between the cover and cable being made to effect physical attachment. In this case, a cross-shot shuttle loom may be employed.

The unitary woven electrical transmission cable and jacket have been described and illustrated as woven on a needle loom. In this case, one of the edges of the unitary construction includes the catch cord which catches and is knitted with the weft element along the length of the woven construction on the one side and each pick will include the weft yarn doubled on itself as is conventional with needle loom construction. Other looms and woven constructions may be had while utilizing the invention herein.

While any desired termination of the conductors may be had, FIG. 4 illustrates one such embodiment wherein all of the ground conductors **16*b*** are broken out on top of the closed cover structure for termination to a common bus bar. The signal conductors are floated out on both sides of the flat woven structure for a selected termination.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. A jacketed woven transmission cable comprising:

a woven electrical transmission cable including a number of warp conductor elements for transmitting electrical signals interwoven with a cable weft element;

a tubular woven cover about said woven electrical transmission cable in an open tubular configuration which includes cover warp elements interwoven with a cover weft yarn element around said woven cable;

said woven cover and woven transmission cable being connected together by weaving said cable and cover together at predetermined picks of one of said weft elements to provide a unitary construction;

a non-jacketed section at each end of said cable wherein said cover warp and said cover weft elements are woven in a closed flat weave structure which closes said tubular configuration of said woven cover at the beginning of said non-jacketed sections; and said warp conductor elements being woven through said flat closed weave structure of said woven cover at said non-jacketed sections lying on either side of said flat weave structure in a separated unbound configuration so that said conductor elements may be terminated and said woven cover is closed, where said warp conductor elements are terminated.

2. The cable of claim 1 wherein said cover weft yarn element and said transmission cable weft element consist of a single common weft element.

3. The cable of claim 1 including a stiffening warp member woven in the woven transmission cable at outermost edges thereof having a heavier gauge than the remaining of said transmission cable warp elements and around which said cover weft yarn element passes in said construction to oppose the tendency of said cover weft yarn element to pull in the sides of said cable.

4. A method of producing individual woven jacketed electrical transmission cables comprising:

weaving a continuous length cable structure which includes a plurality of said jacketed cable sections and a plurality of non-jacketed cable sections;

weaving said jacketed cable sections by weaving a woven cable having a number of warp conductors for transmitting electrical signals together with a weft element, simultaneously weaving a tubulr woven cover in an open tubular configuration by weaving cover warp and cover weft elements around said woven cable, and interweaving said woven cable and woven cover at selected points of weaving to provide a one-piece construction;

weaving said non-jacketed cable sections by reducing the weaving of said woven cover from an open tubular weave to a closed flat weave and breaking out said warp conductors through said woven cover and floating said warp conductors on either side of said flat weave in a separated unwoven configuration in said non-jacketed cable section; and severing said cable structure across selected sections of said cable structure to produce the individual woven jacketed transmission cables.

5. The method of claim 4 including weaving a number of cut-line sections in said continuous length cable in which said warp conductors are bound, and severing said continuous length cable across said cut-line sections.

6. The method of claim 5 wherein said cut-line section is woven in the form of a jacketed cable section.

7. The method of claim 4 including weaving a number of jacketed cable sections in said cable structure having a length corresponding generally to a desired length of an individual one of said jacketed electrical transmission cables being produced;

weaving a number of auxiliary cut-line jacketed cable sections in said cable structure having a minor length; and severing said cable structure across said auxiliary cut-line cable sections to produce said individual jacketed electrical transmission cables.

8. The method of claim 4 including:

weaving a number of main jacketed cable sections in said cable structure having a length corresponding generally to a desired length of an individual one of said jacketed electrical transmission cables being produced;

weaving said non-jacketed cable sections in spaced-apart pairs of adjacent non-jacketed cable sections along the length of said cable structure;

weaving an auxiliary cut-line jacketed cable section between each of said adjacent non-jacketed cable sections in said space therebetween; and severing said cable structure across said auxiliary cut-line jacketed sections.

9. The method of claim 4 wherein said woven cover and woven cable are interwoven together by weaving a common weft element through said cable and cover.

10. A method of producing individual unitary woven jacketed electrical transmission cables comprising:

weaving a continuous length of cable structure which includes a plurality of said individual jacketed cable sections and a plurality of non-jacketed cable sections;

weaving said jacketed cable sections to include a woven cable in which a number of cable warp conductors for transmitting electrical signals are interwoven with a cable weft element, weaving a woven cover about said woven cable by interweaving a plurality of cover warp elements and a cover weft element, and connecting said woven cable and woven cover by interweaving said woven cable and woven cover at selected points of weaving;

weaving said non-jacketed cable sections by weaving said cover weft and warp elements in a closed flat weave structure, and weaving said cable warp conductors outwardly through said flat weave structure so that said warp conductors are floated unbound on either side of said flat closed cover structure;

weaving a plurality of cut-line sections in said continuous length cable structure in which said cable warp conductors are bound in the weave; and severing said continuous length cable structure across said cut-line sections producing a number of individual woven jacketed transmission cables.

11. The method of claim 10 wherein said cut-line section is woven in the form of said jacketed cable section.

12. The method of claim 10 including:

weaving a pair of said non-jacketed sections, a first of said non-jacketed sections being at the ending of a jacketed section and a second of said pair of non-jacketed sections being at the beginning of an adjacent jacketed section to define a pair of adjacent non-jacketed sections with a space therebetween; and weaving said cut-line section between each said pair of non-jacketed sections in said space.

13. The method of claim 10 wherein said cable weft element and cover weft element consist of a single weft element.

14. The method of claim 10 wherein said non-jacketed section includes the cover weft elements and cable weft elements woven together in said closed flat weave structure.

15. The method of claim 10 including:

crossing said warp conductors and said cover warp elements in said flat woven structure to provide a closure of the interior of said open tubular cover;

terminating said cable by affixing a terminal connector adjacent said non-jacketed section at said closure of said woven cover.

16. A method of constructing a unitary jacketed woven electrical transmission cable of the type which includes a woven cover and an inner woven electrical transmission cable having a plurality of warp elements including a number of elongated electrical conductors extending in a warp direction of the cable comprising:

weaving said transmission cable warp elements and a first weft yarn element together to form said inner woven electrical transmission cable;

simultaneously weaving a plurality of cover warp elements including warp yarns and a second weft yarn element to form said outer woven cover about said inner woven transmission cable while said transmission cable is being woven;

interweaving one of said weft yarn elements with one of said warp elements so that said inner woven electrical transmission cable and said outer woven cover are simultaneously woven and attached together as one-piece; and weaving a plurality of longitudinal non-jacketed sections at terminal ends of said cable in which said woven cover is reduced from a tubular weave to a close flat weave and said elongated electrical conductors are broken out of said woven cover and floated freely on each side of said close flat weave of said woven cover.

17. The method of claim 16 wherein said first and second weft yarn elements are woven together with said cover warp yarns in said longitudinal non-jacketed section.

18. The method of claim 16 wherein said first and second weft yarn elements consist of a single weft yarn element.

19. The method of claim 16 including terminating said electrical conductor elements which are floated freely on each side of said closed flat weave by affixing said conductors to a terminal connector, and attaching said terminal connector to said non-jacketed section of said cable at a closure of said woven cover whereby the interior of said woven cover in said jacketed section is closed to said terminal connector.

20. The method of claim 16 including terminating the ends of said elongated conductors in said non-jacketed sections by fixing said ends to a terminal connector.

21. The method of claim 16 including:

crossing said electrical conductors and said cover warp elements in said flat woven structure to provide a closure of the interior of said open tubular cover;

terminating said cable by affixing a terminal connector adjacent said non-jacketed section at said closure of said woven cover.

22. A method of producing individual woven jacketed electrical transmission cables comprising:

weaving a continuous length cable structure which includes a plurality of said individual jacketed cable sections, a plurality of non-jacketed cable sections, and a plurality of auxiliary cut-line cable sections;

weaving said jacketed sections by weaving a woven cable which includes a number of warp conductors for transmitting electrical signals bound with a weft element, simultaneously weaving a tubular woven cover including cover warp and weft elements in an open tubular configuration around said woven cable, and interweaving said woven cable and woven cover at selected points of weaving to provide a one-piece construction;

weaving said non-jacketed cable section by reducing the weaving of said woven cover from an open tubular weave to a closed flat weave and breaking-out said warp electrical conductors through said woven cover and floating said warp conductors on either side of said flat weave in a separated unwoven configuration;

weaving said auxiliary cut-line sections by weaving said warp conductors in a bound configuration;

weaving said jacketed cable sections, non-jacketed cable sections, and cut-line cable sections in the following order;

(i) weaving a cut-line cable section, (ii) weaving a non-jacketed cable section, (iii) weaving a jacketed cable section;

(iv) weaving a non-jacketed cable section, (v) weaving a cut-line cable section, and repeating steps (ii) through (v) along the length of said continuous cable structure generally for each individual jacketed cable being produced; and severing said continuous length cable structure across said cut-line sections to produce individual jacketed electrical transmission cables.

23. The method of claim 22 including crossing said warp conductors and said cover warp elements to close the open interior of said woven cover at the juncture of said non-jacketed sections; and terminating said cable by fixing a terminal connector at said non-jacketed cable sections to said jacketed cable section so that the open interior of said woven cover is closed at said terminal connector by said crossing warp conductors and warp elements.

* * * * *